United States Patent [19]

Lalancette et al.

[11] Patent Number: 4,604,140

[45] Date of Patent: Aug. 5, 1986

[54] FOUNDRY SANDS DERIVED FROM SERPENTINE AND FOUNDRY MOLDS DERIVED THEREFROM

[75] Inventors: Jean M. Lalancette; Jean P. Chevalier-Bultel, both of Sherbrooke; Luc Desrosiers, Rock Forest, all of Canada

[73] Assignee: Societe Nationale de l'Amiante, Quebec, Canada

[21] Appl. No.: 604,039

[22] Filed: Apr. 26, 1984

[51] Int. Cl.[4] ..... B23B 7/28

[52] U.S. Cl. ..... 106/38.9; 106/38.3

[58] Field of Search ..... 106/38.3, 38.9; 423/167

[56] References Cited

U.S. PATENT DOCUMENTS 2,786,771 3/1957 Waterhouse et al. ..... 106/38.9

3,722,574 3/1973 Anderson et al. ..... 106/38.3

4,102,689 7/1978 Borom ..... 106/38.9

*Primary Examiner*—Paul Lieberman

*Assistant Examiner*—Willie Thompson

*Attorney, Agent, or Firm*—Cushman, Darby & Cushman

[57] ABSTRACT

There is disclosed a granular product suitable for use as foundry sands and obtained from asbestos tailings calcined at a temperature of from 1250° to 1450° C., said asbestos tailings having an $MgO:SiO_2$ ratio greater than 1.0, the granules constituting the granular product being characterized by having a thermal expansion at 1000° C. of not more than 1.0% and a particle size of between −20 to +200 mesh (Tyler), the granules being further characterized by being made up mainly of particles of enstatite bonded by gruenerite and fayalite, and substantially unreactive to basic oxides present in the cast metal.

2 Claims, No Drawings

FOUNDRY SANDS DERIVED FROM SERPENTINE AND FOUNDRY MOLDS DERIVED THEREFROM

PRIOR ART

Silica in the form of quartz particles is a material of wide use in foundry applications.

In foundry practice, silica sand, because of its insulating and refractory properties, has been used for manufacturing cores and molds and in general as an insulating material for more than a century.

However, the use of silica presents a certain number of drawbacks. For example, silica, specially in processes where new surfaces are generated on the silica grains by either abrasion or impact, has been found extremely active where in contact with living organism. This is particularly true when silica dust is inhaled, such conditions being held responsible for silicosis, a widely spread disease in areas exposed to high level of silica dust.

Another disadvantage is that silica obtained by mining deposits of silica, is sieved and sometimes ground to proper mesh size before use. These operations fracture the silica particles leaving their structure weakened by microfractures, thus rending said particles rather fragile upon impact. This relative weakness of the silica grains explains the large amount of dust generated when the material is used under conditions of severe mechanical attrition.

In the foundry industry, very substantial amounts of silica dust is also generated by thermal shocks and handling. The situation is such as to represent a major health problem. For those reasons and because of the limits in the refractory properties of silica, particularly with metals having a basic oxide, many foundries have attempted to replace silica by different materials presenting an improved refractory behaviour, this last property being particularly appreciated in the manufacture of cores.

SUMMARY OF THE INVENTION

In accordance with the present invention there is provided a novel foundry sand which overcomes the drawbacks of natural sand heretofore used as foundry sands while presenting unexpected novel and improved properties.

Essentially, the novel foundry sand of the present invention is derived from asbestos tailings calcined at a temperature of from 1250° to 1450° C. The asbestos tailings used as starting material are not demagnetized and are characterized by having a basicity index or an $MgO:SiO_2$ ratio ($I\beta$) above 1.0. The granular foundry sand of the present invention is characterized by having a cold compressive strength of from 3.0 to 36.0 MPa and a thermal expansion at 1000° C. of the order of 1.0%. Furthermore, the foundry sands of the present invention are substantially unreactive to basic oxides when present in cast metal.

Furthermore, the granular foundry sand of the present invention is made up essentially of enstatite particles bonded together by iron metasilicate (gruenerite) and iron orthosilicate (fayalite).

DESCRIPTION OF THE INVENTION

Serpentine is an hydrated variety of magnesium silicate and occurs naturally in very large amounts, particularly as rejects or tailings from asbestos mining. A thermal treatment should in principle be able to transform this serpentine into an anhydrous magnesium silicate in accordance with the following equation:

$$\underset{\text{Asbestos tailings}}{3MgO.2SiO_2.2H_2O} \longrightarrow 3MgO.2SiO_2 + 2H_2O$$

However, it is well known to those familiar in the art of calcined products that a calcining operation, specially when accompanied by gas evolution from the calcined species, most often leads to a very fragile and porous entity. For example, in the course of the manufacture of quick lime, limestone, a relatively hard and dense material, is transformed into a friable and porous mass by loss of carbon dioxide.

When serpentine tailings are calcined at a temperature required for its dehydration, between 750° and 850° C., it has been noted that a pattern similar to limestone occurs in the mass, it becomes quite soft and is easily converted into fine dust following the thermal treatment. The heat treatment at 750° C. to 850° C. is quite efficient for the removal of any residual chrysotile fibers from those tailings through dehydration, but the end product is next to useless as foundry sand because of its softness and poor mechanical strength.

An obvious solution to this weakness of the calcined material would be to raise the calcining temperature to such a value that there would be a partial melting of the magnesium silicate in order to generate a ceramic bond between the particles. Upon examination of the phase diagram for the system $MgO/SiO_2$, one can note that the temperature of melting for the $3MgO.2SiO_2$ is in the area of 1700°–1800° C. Such a high temperature of fusion precludes the economical use of a material calling for such treatment.

However, contrary to what could be expected from the $3MgO.2SiO_2$ system, it has surprisingly been found that a thermal treatment at a much lower temperature, in the range of 1250° to 1450° C., gives a highly sintered material having excellent mechanical properties and thus highly useful as foundry sands.

Without going into limitative theoretical considerations, this unexpected case of ceramic bonding can be explained by a close examination of the chemistry involved in the course of the thermal treatment. It must be noted here that a serpentine tailing contains, beside MgO and $SiO_2$, up to 9% of iron oxides expressed as FeO and $Fe_2O_3$ combined. When the material is subjected to heat, the first reaction is a dehydration as noted in the following equation:

$$3MgO.2SiO_2.2H_2O.n(FeO, Fe_2O_3) \xrightarrow{750\text{–}850^\circ\ C.} 2H_2O + 3MgO.2SiO_2.n(FeO, Fe_2O_3)$$

This dehydration is completed at 900° C. Above that temperature, the production of forsterite will predominate up to 1200° C. This production of forsterite is accompanied by an evolution of free silica as shown in the following equation:

$$2[3MgO.2SiO_2.n(FeO, Fe_2O_3)] \xrightarrow{900\text{–}1200^\circ\ C.} \underset{\text{Forsterite}}{3[(2MgO.SiO_2).2/3n(FeO, Fe_2O_3)]} + \underset{\text{Free silica}}{SiO_2}$$

As the temperature reaches 1300° C., the system evolves towards the production of enstatite which is, in fact, a recombination of free silica previously liberated.

This reaction is rapid above 1300° C.

$$2MgO.SiO_2 + SiO_2 \xrightarrow{1300^\circ C.} 2MgO.SiO_2$$

Forsterite Enstatite

The mixture of forsterite and enstatite in the proportion delimited by the starting serpentine has a very high melting point above 1700° C. as indicated before. However, the presence of iron oxides in the tailings allows the formation of much more fusible iron silicates such as gruenerite and fayalite. Therefore, it is believed that the unexpected low sintering temperature of serpentine tailings can be explained by the formation of iron metasilicate ($FeSiO_3$) also known as gruenerite and iron orthosilicate ($Fe_2SiO_4$) also known as fayalite from the iron oxides present naturally in the material and the silica liberated by the production of forsterite.

For the contemplated uses of calcined tailings as foundry sand, the hardness of grains is always a consideration of great importance for cost reduction by allowing recycling of the sand. Furthermore, beside hardness of grain, the refractory properties are of obvious significance. It has been noted that the basicity index ($1\beta$) varies from one asbestos mine to another. Also, it has been noted that a low basicity index (i.e. $1\beta$smaller than 1.00) corresponds to a lower refractoriness but a more complete vitrification at a given temperature thus leading to a harder product obtainable at lower temperatures.

This point is well illustrated by Table I, where the hardening resulting from sintering is noted for two different types of tailings of high and low basicity index.

TABLE I

COMPARISON OF HEAT SINTERING OF TAILINGS

| | Chem. Analysis | | | Cold compression strength (MPa) after firing at indicated temperature | | | | | |
|---|---|---|---|---|---|---|---|---|---|
| SOURCES | MgO | $SiO_2$ | $1\beta$ | 1150° C. | 1200° C. | 1250° C. | 1300° C. | 1400° C. | 1440° C. |
| Bell Mines Quebec | 35% | 40.3% | 0.86 | 1.04 | 0.63 | 4.35 | 10.29 | 68.74 | 157.84 |
| Carey Mines Quebec | 40.5% | 37.1% | 1.09 | 2.02 | 1.98 | 2.02 | 1.93 | 2.48 | 4.73 |

It will be readily noted that Bell tailings ($1\beta=0.86$) are advantageous for the production of highly sintered material because they are more readily fusible at a temperature of 1300° C. The mechanical strength of the material resulting from the thermal treatment under those conditions is substantially higher than what is observed with basic tailings as illustrated by Carey material ($1\beta=1.09$). On the other hand, if refractory performances are looked for as it is the case with foundry sand, it is obvious that basic tailings, because of their sluggishness towards sintering, are much more attractive than acidic tailings that will be readily vitrified, in the range of 1350° C. to 1450° C.

It is known that in foundry sand, the mechanical requirement on the grains is less critical than refractoriness because of the high temperature encountered in the course of casting operations. Therefore, one will select tailings in accordance to its basicity in order to minimize the energy investment required for the calcination while obtaining appropriate mechanical strength and refractoriness.

FOUNDRY SAND

The following example illustrates the implementation of the invention in the area of foundry sand.

The starting material is tailings from a mine where the basicity index ($I\beta$) is of the order of 0.90 to 1.10. Those tailings are calcined in a rotary kiln at a temperature of 1300° C. for a period of one hour. The mesh size of the retained material after screening is −30 to +150 mesh (Tyler). This sieved fraction can be used for the manufacture of molds or cores calling upon standard methods of general use in the foundry industry.

It is important to have a foundry sand that can be bonded by using standard techniques in this industry. Therefore, we have examined the different types of bonding agents currently found in foundries.

Comparative data between silica and calcined tailings are found in Table II with bentonite as the bonding agent. In general, it can be said that, with this bonding agent of general use, an adequate strength of molds is obtained. Since material of the present invention is substantially more refractory than silica sand, the resulting castings show a better surface finish, said castings being closer to the intended sizes because of a better dimensional stability of the molding sand derived from asbestos tailings. Finally, the sand of the present invention, being manufactured by sintering, is much more resistant mechanically thus generating less dust and therefore can be re-used or re-circulated more often than silica sand.

For the manufacture of cores or inner components of molds, one finds a variety of sand binding agents such as sodium silicates, phenolic resins or other organic binders. Those binders, although not exclusive to cores, are particularly critical when used in said cores because of stringer requirements in that situation. Particularly, the cores must have a good resistance to erosion and demonstrate an ability to be removed easily from the casting. Although such properties do not lend easily to a quantitative measurement, it has been noted during actual casting tests that cores made of calcined tailings sand were showing particularly improved performances in comparison to silica sand on both counts.

In summary, the calcined tailings have been found to be superior to silica as foundry sand. Beside being devoided of noxious free silicate dusts, they are more refractory, easily bonded, less dusty, giving a better finish to castings, and can be recycled.

The present invention will be more readily understood by referring to the following example.

EXAMPLE 1

In a typical casting experiment, a 162 kg sample of molding sand was prepared by mixing 16.3 kg of bentonite with 136 kg of tailings calcined at 1300° C. A minor addition of organic flower (0.70 kg) and coal dust (9.5 kg) completed the formulation which was blended with 6.5 kg of water with a Simpson mueller for six minutes.

The resulting sand was formed in a mold using standard techniques of foundry. The characteristics of this molding mixture are presented in Table II. The cast iron molding presented a particularly good finish, without adhesion of the sand to the casting or erosion of the mold by the circulation of the molten metal in the mold. Two foundry molds made up with silica sand (−30 to +150 mesh) and calcined serpentine residues (−30 to +150 mesh) respectively were submitted to different tests and the results are reported in Table II.

TABLE II

COMPARISON OF FOUNDRY SANDS BONDED WITH 12% BENTONITE

| | Silica sand (Ottawa sand) −30 +150 mesh | Calcined serpentine −30 +150 mesh |
|---|---|---|
| Permeability | 150[1] | 160[1] |
| Compaction under loading | 56[2] | 58[2] |
| Rupture under compression in green shapes | 0.80[3] | 1.00[3] |
| Water content in green shapes | 4.4[4] | 5.0[4] |
| Thermal expansion at 1000° C. | 1.7[5] | 1.0[5] |
| Resistance to basic oxides | Very poor | Good |
| Percentage of fine (−200 mesh Tyler) | 19.16[6] | 10.89[6] |

TABLE II-continued

COMPARISON OF FOUNDRY SANDS BONDED WITH 12% BENTONITE

| | Silica sand (Ottawa sand) −30 +150 mesh | Calcined serpentine −30 +150 mesh |
|---|---|---|
| after one casting | | |

[1] $\frac{cm^2}{g}$ · sec. as per AFS Mold and Core Test Handbook, American Foundry Society*
[2] In percent as per AFS*
[3] In kg/cm² as per AFS*
[4] In percent of water, using the calcium carbide method prescribed by AFS*
[5] Dilatometer Harrop model TD-716, in percent.
[6] In percent as determined from Meehanite Procedures.

ANALYSIS OF TABLE II

It can be readily noted from the examination of Table II that while calcined serpentine is comparable to silica in terms of permeability, compaction under loading and rupture under compression, the thermal expansion is much smaller and the resistance to basic oxides quite superior. The smaller thermal expansion results in more accurate moldings, the shape of casting being closer to intended values. Such precision casting is much sought after in foundries. As to the resistance to basic oxides, the advantage of calcined tailings over silica can be explained by the basic character of the calcined tailings ($MgO/SiO_2$ larger than 1.00) while pure silica as in silica sand is quite acidic at high temperature.

Finally, the lower percentage of dust observed with calcined tailings facilitates the recycling of the sand and represents an important economical advantage of the calcined tailings over silica.

What is claimed is:

1. A granular product suitable for use as foundry sands and obtained from asbestos tailings calcined at a temperature of from 1250° to 1450° C., said asbestos tailings having an $MgO:SiO_2$ ratio greater than 1.0, the granules constituting the granular product being characterized by having a thermal expansion at 1000° C. of not more than 1.0% and a particle size of between −20 to +200 mesh (Tyler), the granules being further characterized by being made up mainly of particles of enstatite bonded by gruenerite and fayalite, and substantially unreactive to basic oxides present in the cast metal.

2. A casting mold made of granular foundry sand obtained from asbestos tailings calcined at a temperature of from 1250° to 1450° C., said asbestos tailings having an $MgO:SiO_2$ ratio greater than 1.0, the granules constituting the granular product being characterized by having a thermal expansion at 1000° C. of not more than 1.0% and a particle size of between −20 to +200 mesh (Tyler), the granules being further characterized by being made up mainly of particles of enstatite bonded by gruenerite and fayalite, and substantially unreactive to basic oxides present in the cast metal.

* * * * *